United States Patent [19]

Glushko et al.

[11] 4,270,341

[45] Jun. 2, 1981

[54] METHOD OF MAKING A SHAPE-STRANDED ROPE

[76] Inventors: Mikhail F. Glushko, prospekt Shevchenko, 15/5, kv. 17; Viktor K. Skalatsky, ulitsa Zhukovskogo, 5, kv. 25; Anatoly D. Zakhryamin, ultisa Yaroslavskogo, 45, kv. 14; Gennady F. Shamrai, prospect Shevchenko, 15/5, kv. 17, all of Odessa, U.S.S.R.

[21] Appl. No.: 969,890

[22] Filed: Dec. 15, 1978

[51] Int. Cl.[3] ..... D07B 5/10; D07B 1/16

[52] U.S. Cl. ..... 57/215; 57/7; 57/9; 57/217; 57/219; 57/221; 57/311

[58] Field of Search ..... 57/212, 213, 215, 216, 57/217, 311, 3, 6, 9, 15

[56] References Cited

U.S. PATENT DOCUMENTS

| | | | |
|---|---|---|---|
| 2,156,652 | 5/1939 | Harris | 57/215 |
| 3,425,207 | 2/1969 | Campbell | 57/217 |
| 3,457,718 | 7/1969 | Otto et al. | 57/9 |

*Primary Examiner*—Donald Watkins

*Attorney, Agent, or Firm*—McAulay, Fields, Fisher, Goldstein & Nissen

[57] ABSTRACT

The disclosed method of making a shape-stranded rope includes twisting large wires into strands by twining them in at least one layer about a core with a sheathing of a soft deformable material, plastic drawing of the strands, forming the strands into a shaped profile and twisting the strands into the rope. The plastic drawing is effected until every round wire of the strand acquires a wedge-like profile, with the wires adjoining the sheathing becoming partly embedded in this sheathing, and the strand acquires a substantially smooth peripheral surface. The method enables, while using round wires, to increase the structural density of the strands, and also to enhance the flexibility, strength and wear resistance of the shape-stranded rope, the rope manufactured by the disclosed method being usable by various industries.

9 Claims, 7 Drawing Figures

METHOD OF MAKING A SHAPE-STRANDED ROPE

FIELD OF THE INVENTION

The present invention relates to wire rope and cable production, and more particularly it relates to methods of manufacturing a wire shape-stranded rope of metal wires, such as a trihedral-strand rope, the shape-stranded ropes manufactured by the disclosed method being usable by various industries.

BACKGROUND OF THE INVENTION

At present, there are known most various structures of shape-stranded ropes, from which variety two groups can be discriminated, the first group including shape-stranded ropes wherein the strands have wires of round cross-section wound about the core (see, for example, the DT Patents Nos. 567,004 and 830,015; the U.S. Pat. No. 3,457,718; the SU Inventor's Certificate No. 500,305), while the second group includes shape-stranded ropes wherein the strands have wires of shaped cross-section wound about the core (see, for example, the DT Pat. No. 656,123; the U.S. Pat. No. 2,122,911, etc.).

However, the ropes of the first group have drawbacks arising mainly from this very round cross-section of the wire, of which the major ones are the relatively low degree of the filling of the cross-sectional area with the rope material, the ribbed external surface of the strands, the inadequate wearability and structural density of the strands.

The known methods of manufacturing such ropes are based on twisting round wires into strands by winding them without practically altering their profile in at least one layer about a core with a sheathing of a soft or deformable material, compacting the strands into a shaped profile and twining the strands into the rope.

The strands of the ropes of the second group, as compared with those of the ropes of the first group, have a more smooth peripheral surface and a higher structural density. However, these shape-stranded ropes neither are free from drawbacks resulting from the very structure of the strands requiring for their formation wires of a sophisticated initial profile of a relatively high bending rigidity. The sophisticated and interdependent initial profiles of the wires put strict requirements as to the manufacture, assembling and indexing of the wires relative to one another while a strand is being formed and shaped, which complicates significantly the entire process of manufacturing shape-stranded ropes.

Thus, the hitherto known methods of manufacturing shape stranded ropes do not provide for combining in the same rope the smooth peripheral surface of the strands, the high structural density, the high degree of the filling of the cross-section of the strand with the rope material, the high wearability, strength and flexibility.

SUMMARY OF THE INVENTION

It is the main object of the present invention to provide a method of making a shape-stranded rope, enabling, while using round wires, to increase the structural density of the strands.

It is another object of the present invention to provide a method of making a shape-stranded rope, enabling to enhance the flexibility, strength and wearability of the shape-stranded rope.

It is still another object of the present invention to provide a shape-stranded rope wherein the strands should have a smooth peripheral surface and a high structural density.

These and other objects are attained in a method of making a shape-stranded wire rope, including twisting round wires into strands by winding them in at least one layer about a core with a sheathing made of a deformable material, compacting the strands into a shaped profile and twisting the strands into the rope, in which method, in accordance with the present invention, prior to being compacted into the shaped profile, each strand is plastically drawn to a degree that each round wire acquires a wedge-like profile, the wires adjoining the sheathing of the core becoming partly embedded into this sheathing, and the strand attaining a substantially smooth peripheral surface.

The disclosed method enables to obtain strands with a smooth peripheral surface, the high degree of the filling of the cross-sectional area of the strand with the rope material, and the interdependent dense while relatively mobile structure of the strand made of wires of the initially round cross-section.

The plastic compression of the strand prior to the compacting of its shaped profile provides more favourable conditions of the joint performance of the wires not only one with another, but also with the core. Furthermore, the smooth peripheral surface of the strand not only enhances the compacting of the strand into the shaped profile, but also improves the performance of the rope built up of such strands, particularly, the bending or flexing properties of the rope.

It is expedient that, following the plastic drawing of the strand, the compacting of its shaped profile should be performed for those of the wires which have been embedded in the sheathing to engage the core, so as to enhance the interconnection of the wires and the core, to increase the resistance to lateral loads, while, owing to the presence of the soft deformable material of the sheathing between the areas of the engagement of the wires with the core, enhancing the shock-absorbing capacity of the rope when the latter is jerked in operation.

It is advisable when forming the strands of the rope of several layers of round wires to carry out the plastic drawing with each layer of the wires in succession.

The disclosed method provides for obtaining a shape stranded rope built up of strands of a fancy profile, made of wires wound in at least one layer about a core with a sheathing of a deformable material, in which rope, in accordance with the present invention, the wires of each strand have a wedge-like profile, with the narrowing end facing the core of which the sheathing has the wires adjoining it partly embedded therein, the wires having straightline portions in cross-section thereof and in each strand engaging one another along helical surfaces and jointly presenting the substantially smooth peripheral surface of the strand.

It is expedient that some of the wires of the strand, embedded in the sheathing of the core, should have in cross-section points of direct contact with the core.

Thus, the herein disclosed method of manufacturing a shape-stranded rope is more simple in realization and requires neither special-design complicated equipment nor wires of a sophisticated profile. A shape-stranded wire rope manufactured by this method combines an increased strength with the enhanced wearability and flexibility, which promotes its efficient use in various industries.

BRIEF DESCRIPTION OF THE DRAWINGS

Given below is a detailed description of a method of making a shape-stranded wire rope in accordance with the invention and examples of the structure of a shape-stranded rope manufactured by the herein disclosed method, with reference to the accompanying drawings, wherein.

DETAILED DESCRIPTION OF THE INVENTION

Figure 1:
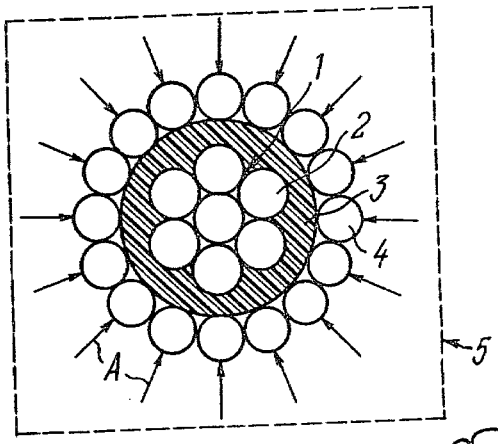
FIG. 1 illustrates schematically a strand built up of round wires, prior to its plastic drawing.

The herein disclosed method of manufacturing a shape stranded rope from metal wires includes providing a core 1 (FIG. 1), e.g. a core made of seven metal wires 2, and applying thereupon a sheathing 3 of a relatively soft deformable material, such as plastics, aluminum, zink, so that a deformable substrate is formed on the core 1. Then round wires 4 are wound about this core 1 in at least one layer, in which way a round strand 5 is obtained.

Figure 2:
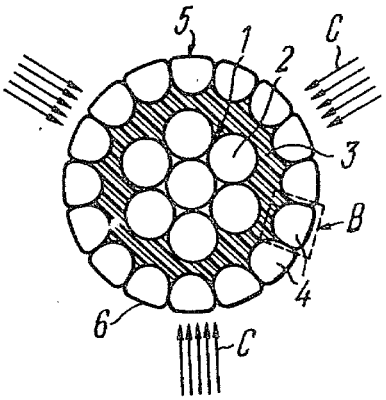
FIG. 2 schematically illustrates the strand of the rope, following the plastic drawing.

The strand 5 thus obtained is then subjected to plastic drawing, the drawing effort being uniformly distributed over the perimeter of the strand, to exert the direct action upon the round wires 4 (the drawing effort is schematically shown in FIG. 1 with arrows A). Under the action of this effort the round wires 4 alter their shape and begin penetrating the sheathing 3 (FIG. 2) of the core 1. This plastic drawing is conducted until each round wire 4 acquires a wedge-like shape B in cross-section, as it is shown in FIG. 2, and becomes partly embedded in the sheathing 3 of the core 1; it should be understood that if the strand 5 is formed by several layers of wires, only the layer adjoining the sheathing 3 becomes partly embedded therein. Under the action of this plastic drawing, the strand 5 acquires a generally smooth peripheral surface 6.

As a result of the drawing and of the wires having attained the wedge-like profile B, all the wires in the strand 5 engage one another and the sheathing 3 of the core 1 along helical surfaces.

Figure 3:
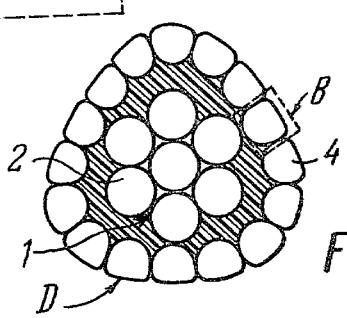
FIG. 3 schematically illustrates the strand of the rope, following its having been compacted into the shaped profile.

Then the strand 5 having the substantially smooth peripheral surface 6 is compacted into the shaped profile, the compacting effort being applied to the strand in the directions illustrated with arrows C, in preselected areas of the perimeter of the strand. Depending on the number and arrangement of the areas whereat the compacting effort is concentrated, the strand 5 acquires the corresponding shaped profile. In FIG. 2 it is shown that the shaping effort is applied at three areas over the perimeter of the strand 5, so that the strand acquires the trihedral profile D shown in FIG. 3.

According to another feature of the present invention, the compacting of the strand is effected until the core 1, i.e. its wires 2, is engaged by those of the wires 4 which have been embedded in the sheathing 3, which increases the structural density of each strand and enhances the strength of the shape-stranded rope built up of such strands.

Figure 4:
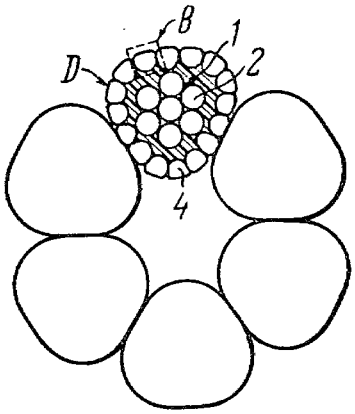
FIG. 4 schematically shows a shape-stranded rope in accordance with the invention, having strands with a single layer of wires.

Then the strands of the shaped profile D are twisted or twined into the shape-stranded rope (FIGS. 4 to 6) by any known per se suitable method in known rope-twisting machines, the number of the strands in the rope being various, e.g. three, four, six, etc. strands, depending on the intended applications of the ropes. For brevity sake, the structure of only one of the strands is illustrated in FIGS. 4 to 6 of the appended drawings, the other strands being symbolically shown as closed contours.

Extending centrally of the rope is a core 7 (FIG. 7) made of any suitable material, e.g. metal wires, an organic or synthetic composition, etc. This core 7 is shown symbolically in FIG. 7 and is not shown in FIGS. 4 to 6, so as not to complicate the drawing; in any case, the core 7 is unessential for the purposes of the present invention.

Figure 7:
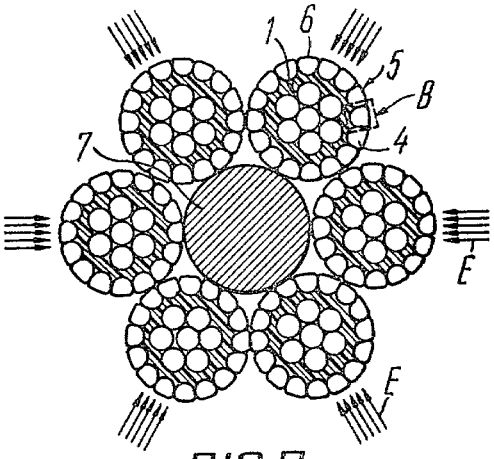
FIG. 7 illustrates the forming of the shape-stranded rope from strands illustrated in FIG. 2, prior to the compacting of the shaped profile of the strands.

The compacting of the shaped profile D (FIG. 3) of a strand may be effected prior to twisting the strands into a rope, directly in the course of twisting the rope (not shown), or else following the twisting of the rope, as it is shown in FIG. 7. In the last-mentioned case the shape stranded rope is twisted from the strands 5 of a circular shape, having a single layer of the wires 4 and the smooth peripheral surface 6. Then the rope thus twisted is acted upon by an effort applied to each strand 5 in the directions indicated with arrows E. Under this effort and the reaction of the adjacent strands each strand acquires the shaped profile D, e.g. that shown in FIG. 4.

Figure 5:
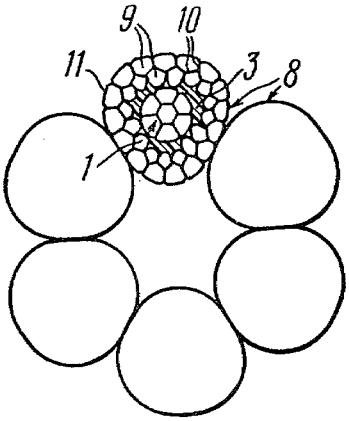
FIG. 5 schematically shows a shape-stranded rope in accordance with the invention, having strands with two layers of wires.
Figure 6:
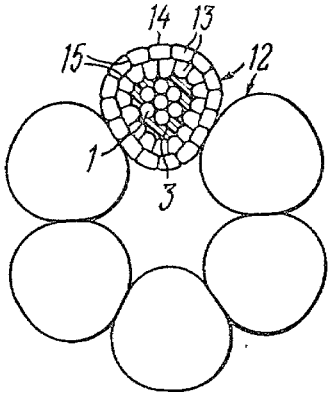
FIG. 6 schematically shows a shape-stranded rope with strands having two layers of wires, each layer having been successively subjected to the plastic drawing.

Shown in FIG. 5 is a shape-stranded (trihedral-strand) rope wherein each strand 8 has two layers of wires 9, all the wires 9 of both layers having a wedge-like shape with rectilinear (in the plane of the drawing) portions 10 enabling the wires 9 to engage one another along helical surfaces not only within the layer, but also between the layers. The wires 9 of the layer adjoining the sheathing 3 of the core 1 are partly embedded in the sheathing 3 and engage the core 1, e.g. at three points. The wires of the core 1 of this embodiment are trapezoidal, except the central wire which is hexahedral in cross-section. In the process of the manufacture of the strands 8 of this rope each strand has been subjected to a single cycle of the plastic drawing during which the round wires 9 of both layer have acquired the wedge-shaped profile with the narrowing end facing the core 1. The wires 9 defining the external layer of the strand 8 have formed, as a result of this plastic drawing, the relatively smooth peripheral surface 11 of the strand 8, while the wires 9 of the other layer adjoining the sheathing 3 have acquired, at their sides facing the external layer, the shape shown in FIG. 5, so that the entire cross-section of the strand is filled with the metal.

Illustrated in FIG. 6 is a shape-stranded (trihedral-strand) rope wherein each strand 12 has two layers of wires 13. The wires 13 of the strand 12 have the wedge-like profile with the narrowing end facing the core 1. The layer of the wires 13 adjoining the sheathing 3 of the core 1 penetrates the sheathing 3 and at some points, e.g. at three points, engages the wires of the core 1. The layer of the wires 13, which is the external one, presents the smooth peripheral surface 14 of the strand 12.

The wires 13 have in cross-section rectilinear portions 15, owing to which the wires within each layer and between the layers engage one another along helical surfaces. In the course of the manufacture of the strands 12 of the rope of this embodiment each strand was subjected to two cycles of the plastic drawing, prior to the compacting of its shaped profile. The first plastic drawing cycle was conducted after the first layer of the wires 13 had been wound about the core 1 with the sheathing 3, whereby the smooth peripheral surface of this layer was attained, and the drawing was conducted until each round wire attained the wedge-like profile, the wires were partly embedded in the sheathing 3 and engaged the core 1, e.g. at three points. As a result of this first compression cycle, the strand has acquired the shape and structure shown in FIG. 2. Then the second layer of round wires 13 (FIG. 6) was wound about the first one, and the strand was subjected to the plastic drawing once again, so that the wires 13 of this layer acquired the wedge-like profile and jointly defined the relatively smooth peripheral surface 14 of this strand 12.

Any required number of the layers in the strand can be compacted in a similar manner.

Then the strand is compacted into the shaped profile, which may be effected prior to twisting the strands into the rope, directly in the process of twisting the rope, or else following the twisting of the rope.

What is claimed is:

1. A method of making a shape-stranded rope, including:

providing a core with a sheathing of a deformable material;

twisting round wires into strands by winding these round wires in at least one layer about said core with the sheathing of the deformable material;

subjecting the strand thus formed to plastic drawing until each said round wire acquires a wedge-like profile, said plastic drawing forcing the wires adjoining the sheathing of said core to become partly embedded in this sheathing, and the strand attains a substantially smooth peripheral surface; following said plastic drawing, compacting the strand thus obtained into a shaped profile, said compacting of the strand into the shaped profile is effected until some of the wires embedded in said sheathing engage said core; and twisting the strands thus obtained into the rope.

2. A method as set forth in claim 1, wherein, with the strand of the rope being formed of several layers of round wires the plastic drawing is conducted with each layer of the wires in succession.

3. The method as set forth in claim 1, wherein said core is formed by a plurality of wire members to which the sheathing of deformable material is applied to form a deformable substrate on the plurality of wire members, and then the round wires are twisted onto the deformable substrate.

4. The method as set forth in claim 1 or 3, in which the plastic drawing is carried out until each of the round wires when in position on the sheathing acquires a wedge-like shape in cross-section with one portion of the wedge-shaped wires becoming embedded in the sheathing and an outer surface away from the sheathing acquires a generally smooth peripheral surface so that all of the original round wires engage one another and the sheathing along helical surfaces.

5. The method as set forth in claim 1 or 3, in which a second layer of round wires is placed onto the first layer of round wires, and subjecting the strand thus formed to a second plastic drawing until each said round wire in the second layer acquires a wedge-like profile with a relatively smooth peripheral surface.

6. A shape-stranded rope comprising strands of a shaped profile;

a core of each said strand with a sheathing of a deformable material thereabout, said core including wire members enclosed within said sheathing;

wires wound in at least one layer about said core with said sheathing of the deformable material and forming said strand jointly with said core;

said wires of each said strand having a wedge-like profile with the narrowing end facing said core, the wires adjoining said sheathing of said core being partly embedded in said sheathing and having points of engagement with said wire members of said core;

said wires having straightline portions in cross-section thereof and in said strands owing to their wedge-like cross-sectional shape, engaging one another along helical surfaces and jointly presenting a substantially smooth peripheral surface of the respective strand.

7. The shape-stranded rope as set forth in claim 6, wherein some of said wire members are embedded within said sheathing, and some of the said wires penetrate through said sheathing for engagement and direct contact with said wire members.

8. The shape-stranded rope as set forth in claim 6, wherein some of said wire members are embedded within said sheathing;

each said strand has two layers of wires, one of which layers is in contact with said sheathing and the other of said layers is in contact solely with said one layer, the wires of both of said layers engaging one another both within the layers and between said layers; and some of said wires of said inner layer penetrate through said sheathing and engage said wire members.

9. The shape-stranded rope as set forth in claim 6, wherein each said strand has two layers of wires, said wires engaging each other along helical surfaces.

* * * * *